US007621207B2

(12) United States Patent
Botsai et al.

(10) Patent No.: US 7,621,207 B2
(45) Date of Patent: Nov. 24, 2009

(54) ADJUSTABLE SLICING DEVICE

(75) Inventors: Kurt Gregory Botsai, Thousand Oaks, CA (US); Lance Gordon Hussey, Simi Valley, CA (US); Ingvald Alain Smith-Kielland, Los Angeles, CA (US); Ravi Sawhney, Calabasas, CA (US); Christopher Glupker, Van Nuys, CA (US)

(73) Assignee: DKB Household USA Corp., Irvine, CA (US)

( * ) Notice: Subject to any disclaimer, the term of this patent is extended or adjusted under 35 U.S.C. 154(b) by 226 days.

(21) Appl. No.: 11/303,439

(22) Filed: Dec. 16, 2005

(65) Prior Publication Data

US 2007/0137457 A1 Jun. 21, 2007

(51) Int. Cl.
*B26D 7/06* (2006.01)

(52) U.S. Cl. ..... 83/698.11; 83/856; 30/278

(58) Field of Classification Search ..... 83/698.11, 83/856, 699, 858, 435.11, 425.3, 932; 30/278, 30/280, 279.6; D7/673, 674
See application file for complete search history.

(56) References Cited

U.S. PATENT DOCUMENTS

| | | | | |
|---|---|---|---|---|
| 557,914 | A | 4/1896 | Struble et al. | |
| 1,416,723 | A | 5/1922 | Krafft | |
| 1,430,289 | A | 9/1922 | Dahmer | |
| 1,768,072 | A | 6/1930 | Keeton | |
| 1,974,194 | A * | 9/1934 | Phillips | 241/101.1 |
| 2,166,622 | A | 7/1939 | Callen | |
| 2,508,320 | A | 5/1950 | Wheelwright | |
| 2,766,793 | A | 10/1956 | Duszynski | |
| 3,286,971 | A | 11/1966 | Walter et al. | |
| 3,495,639 | A | 2/1970 | Johansson | |
| 3,942,399 | A | 3/1976 | Giangiulio | |
| 4,038,892 | A | 8/1977 | Popeil | |
| D249,044 | S | 8/1978 | Popeil | |
| 4,120,089 | A | 10/1978 | Börner | |
| 4,212,431 | A | 7/1980 | Doyel | |
| 4,290,196 | A | 9/1981 | Börner | |
| 4,570,519 | A | 2/1986 | Motosko, II | |
| 4,573,387 | A | 3/1986 | Denter et al. | |

(Continued)

FOREIGN PATENT DOCUMENTS

| | | |
|---|---|---|
| BE | 860642 | 3/1978 |

(Continued)

OTHER PUBLICATIONS

European Search Report dated Mar. 6, 2007 for European Patent Application No. EP 06 12 5725.

*Primary Examiner*—Boyer D Ashley
*Assistant Examiner*—Omar Flores-Sánchez
(74) *Attorney, Agent, or Firm*—Brinks Hofer Gilson & Lione

(57) ABSTRACT

Adjustable slicing devices and blades for the adjustable slicing devices are provided. One slicing device includes a frame having a first configuration and a second configuration. The slicing device further includes a first guide plate and a second guide plate wherein the first and second guide plates are mounted to the frame and include an opening formed between the guide plates in the first configuration. The device includes a first blade mounted in the opening in the first configuration, the blade having a cutting edge, and an adjustment control member having a first position for releasing the frame from the first configuration.

21 Claims, 13 Drawing Sheets

U.S. PATENT DOCUMENTS

| | | | | |
|---|---|---|---|---|
| 4,624,166 | A | 11/1986 | Kreth et al. | |
| 4,733,589 | A | 3/1988 | Wolff | |
| 4,805,843 | A * | 2/1989 | Draper | 241/287 |
| 4,848,680 | A | 7/1989 | Börner | |
| 5,001,835 | A | 3/1991 | Boerner | |
| D326,388 | S | 5/1992 | Boerner | |
| D347,149 | S | 5/1994 | Feer et al. | |
| 5,312,054 | A | 5/1994 | Feer et al. | |
| D354,886 | S | 1/1995 | Diefenbach | |
| 5,419,049 | A * | 5/1995 | MacArthur-Onslow | 30/322 |
| 5,577,807 | A | 11/1996 | Hodge et al. | |
| 5,745,999 | A | 5/1998 | Zirkiev | |
| 5,765,472 | A | 6/1998 | Kim | |
| D399,711 | S | 10/1998 | Cohen et al. | |
| 5,915,788 | A | 6/1999 | Schneider | |
| 6,003,943 | A | 12/1999 | Schneider | |
| 6,082,645 | A | 7/2000 | Himmighofen et al. | |
| D442,033 | S | 5/2001 | de Saint-Genois | |
| 6,318,222 | B1 | 11/2001 | Weinman, Jr. | |
| 6,732,622 | B2 | 5/2004 | Vincent | |
| D495,218 | S | 8/2004 | Yu | |
| 6,805,044 | B1 | 10/2004 | Yamamoto | |
| D498,650 | S | 11/2004 | Boilen | |
| D503,314 | S | 3/2005 | Wong | |
| D505,301 | S | 5/2005 | Wong | |
| 7,066,071 | B2 * | 6/2006 | Zeder et al. | 83/698.11 |
| 7,207,512 | B2 * | 4/2007 | Webb et al. | 241/169 |
| 2004/0216579 | A1 | 11/2004 | Zeder et al. | |
| 2004/0231482 | A1 | 11/2004 | Boilen | |
| 2005/0061124 | A1 | 3/2005 | Vincent | |
| 2005/0217121 | A1 | 10/2005 | Zeder et al. | |
| 2005/0252387 | A1 | 11/2005 | Cornfield | |
| 2006/0075872 | A1 | 4/2006 | Wangler | |

FOREIGN PATENT DOCUMENTS

| | | | |
|---|---|---|---|
| DE | 10154130 | A1 | 5/2003 |
| EP | 1 074 187 | A2 | 2/2001 |
| FR | 2723877 | A3 | 3/1996 |
| FR | 2726780 | A1 | 5/1996 |
| FR | 2859900 | A1 | 3/2005 |
| GB | 2 313 771 | A | 12/1997 |
| JP | 2001 038678 | A | 2/2001 |
| WO | WO 02/068159 | A1 | 9/2002 |

* cited by examiner

ADJUSTABLE SLICING DEVICE

FIELD OF THE INVENTION

The present invention relates to devices for processing food products, and more particularly to manually operated devices having a blade for slicing food.

BACKGROUND

Various food processing devices are known in the art. Some of the devices include a stationary blade supported by a frame. The user manually slides a food product across the frame and the blade to slice the food product. The slicing devices generally include a movable guide and may include a control knob for adjusting the thickness of the slices depending on the type of food being sliced and the desired thickness. A holder may be used with the slicing device to hold the food product and to avoid injury to the user while moving the food product across the sharp cutting blade.

The slicing devices may also include a feature that secures the slicing device to a receptacle, such as a bowl, for receiving the sliced food product. Some devices include legs on one end of the device for elevating the end of the device to provide an angular cutting surface. The slicing devices are typically rectangularly shaped and are long enough to extend across a bowl if desired and also to accommodate larger food products for slicing, such as cucumbers, squash and zucchini.

Theses types of slicing devices typically require sizable storage space. In addition, the blade of the slicing device may be exposed in the storage position so that a person retrieving the slicing device from storage may be accidentally cut by the exposed blade.

BRIEF SUMMARY

In order to alleviate one or more shortcomings of the prior art, adjustable slicing devices that fold for safe and compact storage are provided herein.

In one aspect of the present invention, an adjustable slicing device is provided. The slicing device includes a frame having a first configuration and a second configuration. The slicing device further includes a first guide plate and a second guide plate, where the first and second guide plates are mounted to the frame and include an opening formed between the guide plates in the first configuration. The device includes a first blade mounted in the opening in the first configuration, the blade having a cutting edge, and an adjustment control member having a first position for releasing the frame from the first configuration.

In another aspect of the present invention, an adjustable slicing device is provided. The device includes a foldable frame having an opening formed in the frame. A cutting edge of a blade extends at least partially across the opening. The device further includes a guiding member adjustably mounted in the frame and the guiding member includes an edge portion adjacent the opening. An adjustment control member is mounted to the frame and operates to releasably lock the frame in an open configuration and operates to change a substantially vertical orientation of the edge portion.

In yet another aspect of the present invention, a blade for an adjustable slicing device is provided. The blade includes an elongate body extendable across a portion of an opening in the adjustable slicing device, and a first edge on the body. The first edge includes a plurality of cutting edges extending outwardly from the body into the opening.

An adjustable slicing device is provided, where the device includes a frame having an open configuration for operation and a closed configuration for storage. The device includes a planar region mounted to the frame where the planar region includes an opening formed therein. The device further includes a cutting edge mounted to the frame across at least a portion of the opening and an adjusting member mounted to the frame where the adjusting member is movable to adjust a substantially vertical orientation of a portion of said planar region.

Advantages of the present invention will become more apparent to those skilled in the art from the following description of the preferred embodiments of the invention which hare also shown and described by way of illustration. As will be realized, the invention is capable of other and different embodiments, and its details are capable of modification in various respects. Accordingly, the drawings and description are to be regarded as illustrative in nature and not as restrictive.

DETAILED DESCRIPTION OF THE INVENTION

Figure 1A:
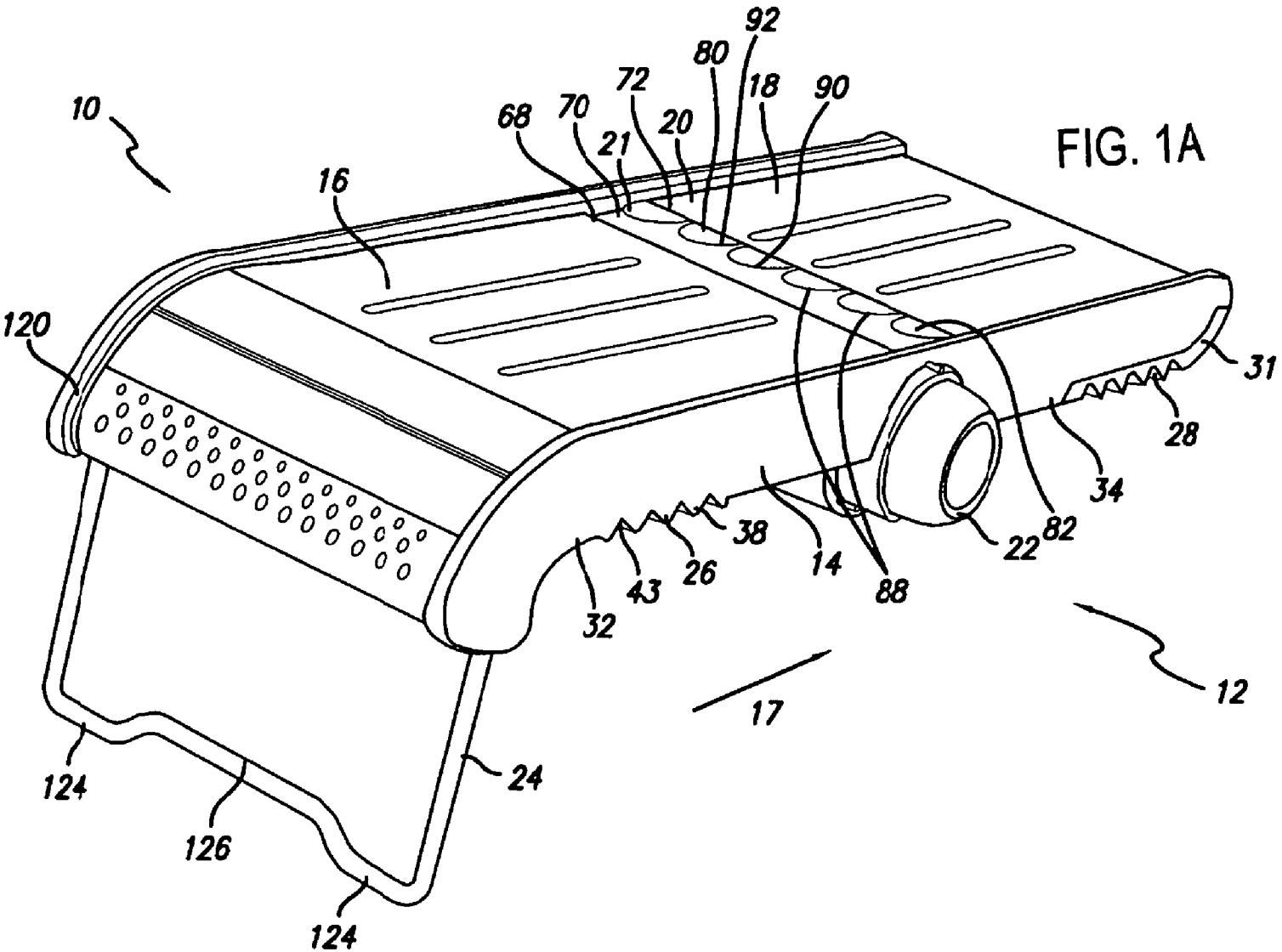
FIG. 1A is a perspective view of an embodiment of the slicing device of the present invention in an open configuration.

An exemplary foldable, adjustable slicing device 10 is shown in FIG. 1A in an open configuration 12. The slicing device 10 may have any general overall shape, including rectangular, square, oval, and the like. Preferably, the device 10 is generally rectangularly shaped and includes a frame 14, a first guiding plate 16, a second guiding plate 18, a blade 20 and an adjustment control member 22. The adjustment control member 22 may be used for releasably locking the device 10 in the open configuration 12 and for modifying the thickness and type of slices resulting from the slicing operation when the food product is guided across the device 10 in a cutting direction 17. The cutting direction 17 is generally parallel to the guiding plate 16 and towards the blade 20. Portions of the frame 14, the first guiding plate 16 and the second guiding plate 18 may be formed from any material having sufficient strength for supporting the slicing operation including but not limited to, metals, plastics and combinations thereof.

Figure 2:
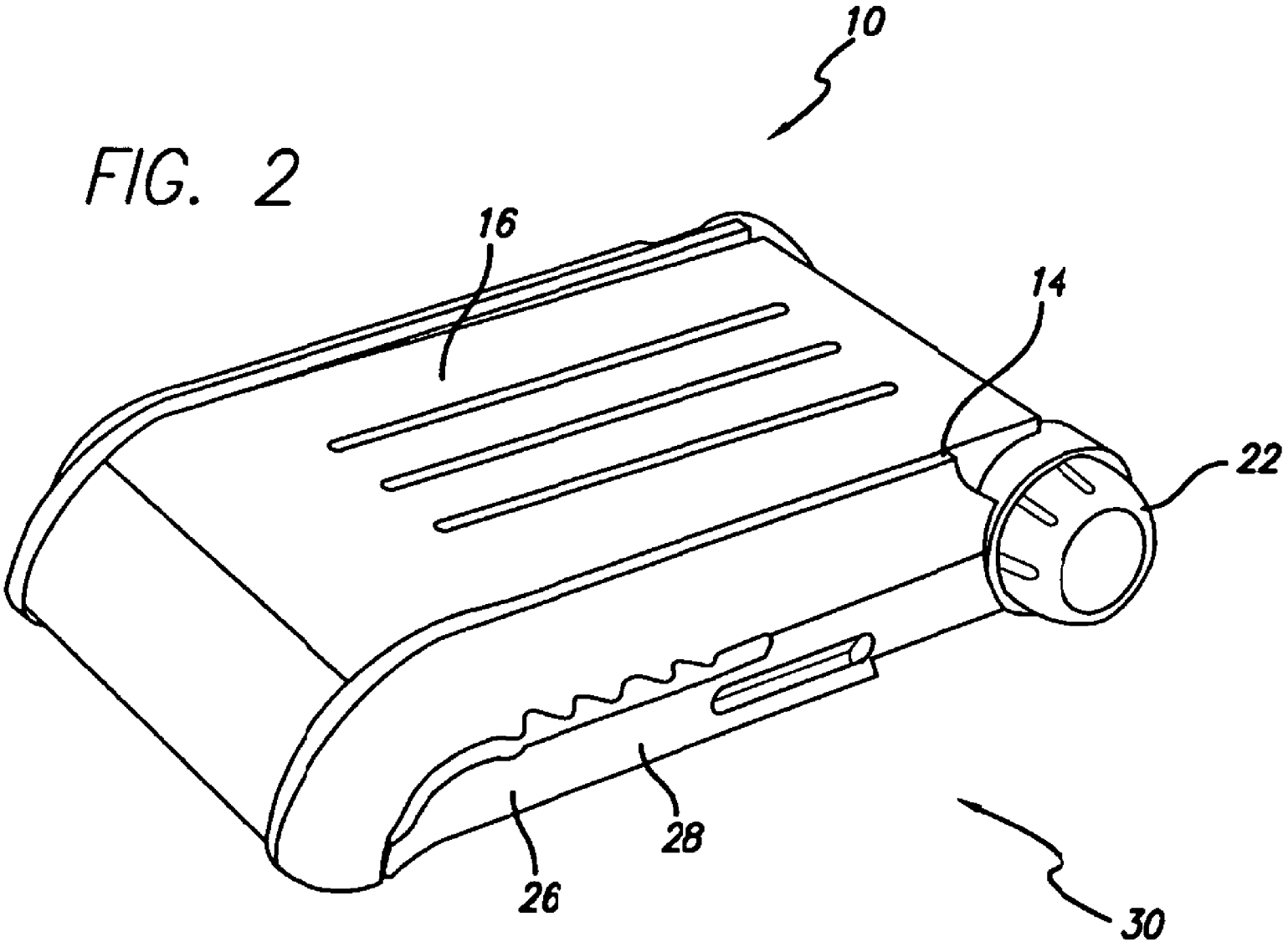
FIG. 2 is a perspective view of the embodiment shown in FIG. 1A in a closed configuration.

The slicing device 10 may further include a stand 24 and serrated edge portions 26 and 28 on a portion of the frame 14. The stand 24 may fold into a lower recess 130 of the device 10 (as described below, and shown in FIG. 4) and the adjustment control member 22 may be used to fold the slicing device 10 from the open configuration 12 used for slicing shown in FIG. 1A to a closed configuration 30 for storage, as shown in FIG. 2. In the closed configuration 30, the slicing device 10 may be folded so that a first side 32 of the first guiding plate 16 and a first side 34 of the second guiding plate 18 face each other and fit together to form the closed configuration 30 for storage shown in FIG. 2. Other storage configurations 30 are possible within the scope of the present invention where the device 10 may be moved to a smaller configuration. When the slicing device 10 is in the closed configuration 30, the serrated edge portions 26 and 28 may fit together so that protrusions 38 of the serrated edge portion 26 on the first guiding plate 16 mate with recesses 40 between protrusions 42 of the serrated edge portion 28 on the second guiding plate 18. Similarly, recesses 43 between protrusions 38 on the first guiding plate 16 mate with the protrusions 42 of the serrated edge portion 28 of the second guiding plate 18.

Figure 3:
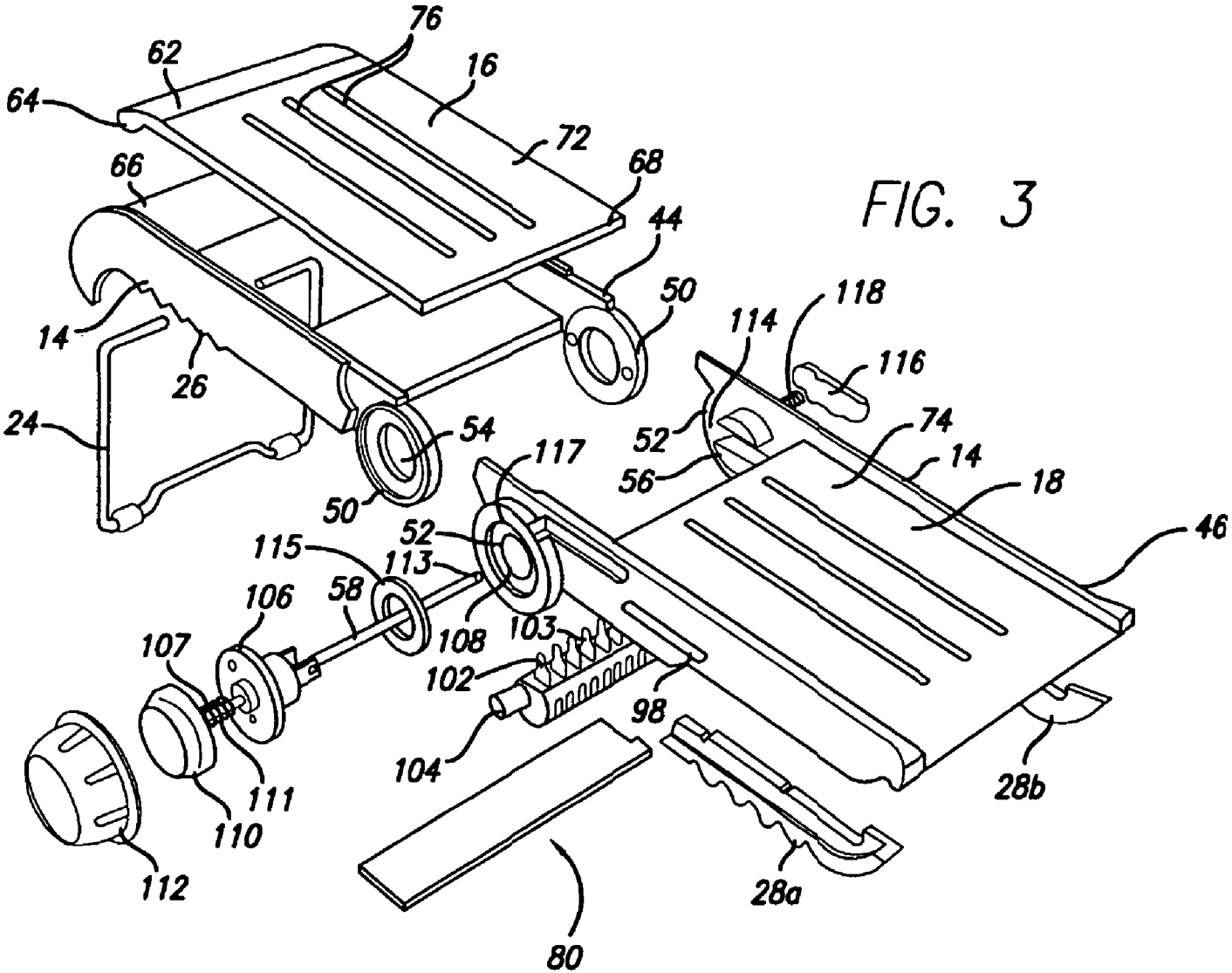
FIG. 3 is an exploded view of the embodiment shown in FIG. 1A.

The frame 14 may be formed from a plurality of frame sections, i.e. two or more, to facilitate folding or otherwise moving the slicing device 10 to the storage configuration 30. Alternatively, the frame 14 may be formed from a single frame section having a pivoting joint to facilitate folding (not shown). As shown in FIG. 3, in some embodiments, the frame 14 is preferably formed from a top frame section 44 and a bottom frame section 46. The frame sections 44 and 46 may be joined together using any mechanism known to one skilled in the art that is suitable for pivotal rotation of the top frame section 44 with respect to the bottom frame section 46. Preferably, the top frame section 44 includes a pair of connecting members 50 that engage with a pair of complimentary connecting members 52 on the bottom frame section 46. As shown in FIG. 3, the connecting members 50 may include openings 54 sized and shaped to engage protrusions 56 formed on the connecting members 52. The connecting members 50, 52 may be sized and shaped to engage one another and be rotatable between the open configuration 12 and the closed configuration 30 by rotating about a shaft 58 of the adjustment control member 22 extending through the connecting members 50, 52.

Figure 4:
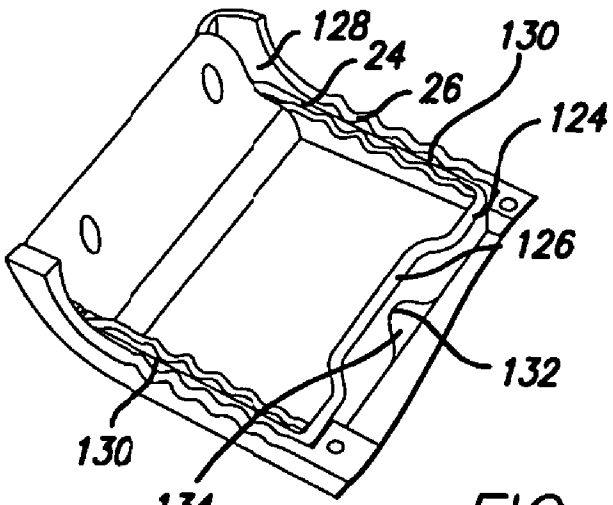
FIG. 4 is a perspective view of a stand of the embodiment shown in a storage position.

As shown in FIGS. 3 and 4, the first guiding plate 16 may be removably mounted within the top frame section 44 and adapted to be displaceable with respect to a cutting blade edge 21 of the blade 80 that is mounted to the second guiding plate 18, upon movement of the adjustment control member 22 (described in further detail below). A first end 62 of the first guiding plate 16 may be pivotally connected to the frame 14, for example by using a hooked portion 64 on the first end 62 to engage a radial portion 66 extending across the top frame 44. A second end 68 of the first guiding plate 16 may be displaceable in a plurality of positions, generally in a vertical direction with respect to the second guiding plate 18. Displacement of the first guiding plate 16 with respect to the cutting blade edge 21 determines the separation of the cutting blade edge 21 from a distal edge 68 of the first guiding plate 16 thereby determining the thickness of the slices cut by the device 10. In some embodiments, the first guiding plate 16 may be non-removably mounted to the top frame section 44.

The second guiding plate 18 may be non-removably mounted in the bottom frame 46 or formed integrally with the bottom frame 46. Alternatively, second guiding plate 18 may be removably mounted in the bottom frame 46. The first guiding plate 16 and the second guiding plate 18 are preferably rectangularly shaped as shown in FIG. 3. However, any shape may be used to form the guiding plates 16 and 18 and the frame 14, including, but not limited to square, oval, round and the like. The first guiding plate 16 may have the same or a different shape or size than the second guiding plate 18. The guiding plates 16 and 18 include first surfaces 72, 74 respectively, which may be smooth or patterned. For example, the first surfaces 72, 74 may include a plurality of grooves 76, as shown in FIG. 3 to assist in guiding food in a direction parallel to the cutting direction 17.

As discussed above, the frame 14 may include serrated edge portions 26 and 28. The serrated edge portions 26, 28 may be formed integrally with the frame 14 or the serrated edge portions 26, 28 may be formed separately and attached to the frame 14. For example, the top frame section 44 may include serrated edge portion 26 that is integrally formed with the top frame section 44 and the bottom frame section 46 may include serrated edge portion 28 that is formed separately from the bottom frame section 46. As shown in FIG. 3, the serrated edge portion 28 may be formed separately and in two pieces 28*a*, 28*b* and joined to the bottom section 46 of the frame 14. Preferably, the serrated edge portions 26, 28 are formed from a material that helps to hold the slicing device 10 in place during operation, for example when the serrated edge portions 26, 28 are placed over the edge of a bowl or when an end 31 of the serrated edge portion 28 is placed on a counter with the guiding plates 16,18 at an angle. Preferably, the serrated edge portion 26, 28 or both may be formed from a rubber material or a polymeric elastomer. Other suitable materials will be understood by one skilled in the art.

As shown in FIG. 1A, the top frame section 44 including the first guiding plate 16 and the bottom frame section 46 including the second guiding plate 18 may be pivotably connected at the connecting members 50, 52 and an opening 70 may be formed between the second end 68 of the first guiding plate 16 and a first end 72 of the second guiding plate 18. A cutting blade 80 may extend across a portion of the opening 70 and the blade 80 may be mounted to the frame 14 as shown in FIG. 1A.

In some embodiments, the blade 80 may be removably mounted to the frame 14, preferably to the bottom frame section 46, and may include first and second cutting edges on either side of the cutting blade so that a different type of cut may be obtained by reversing the blade to expose either edge across the opening 70. Preferably, the blade 80 extends longitudinally across the opening 70 and is generally rectangularly shaped and having one of the cutting edges exposed in the first configuration 12 for slicing the food product in the opening 70. The blade 80 may further include a handle at one end of the blade 80. The handle 86 may be used for removing the blade 80 from the frame 14 to reverse the cutting edge exposed in the opening 70. The blade 80 may be inserted into a slot 81 formed in the frame 14 for use.

Figure 1B:
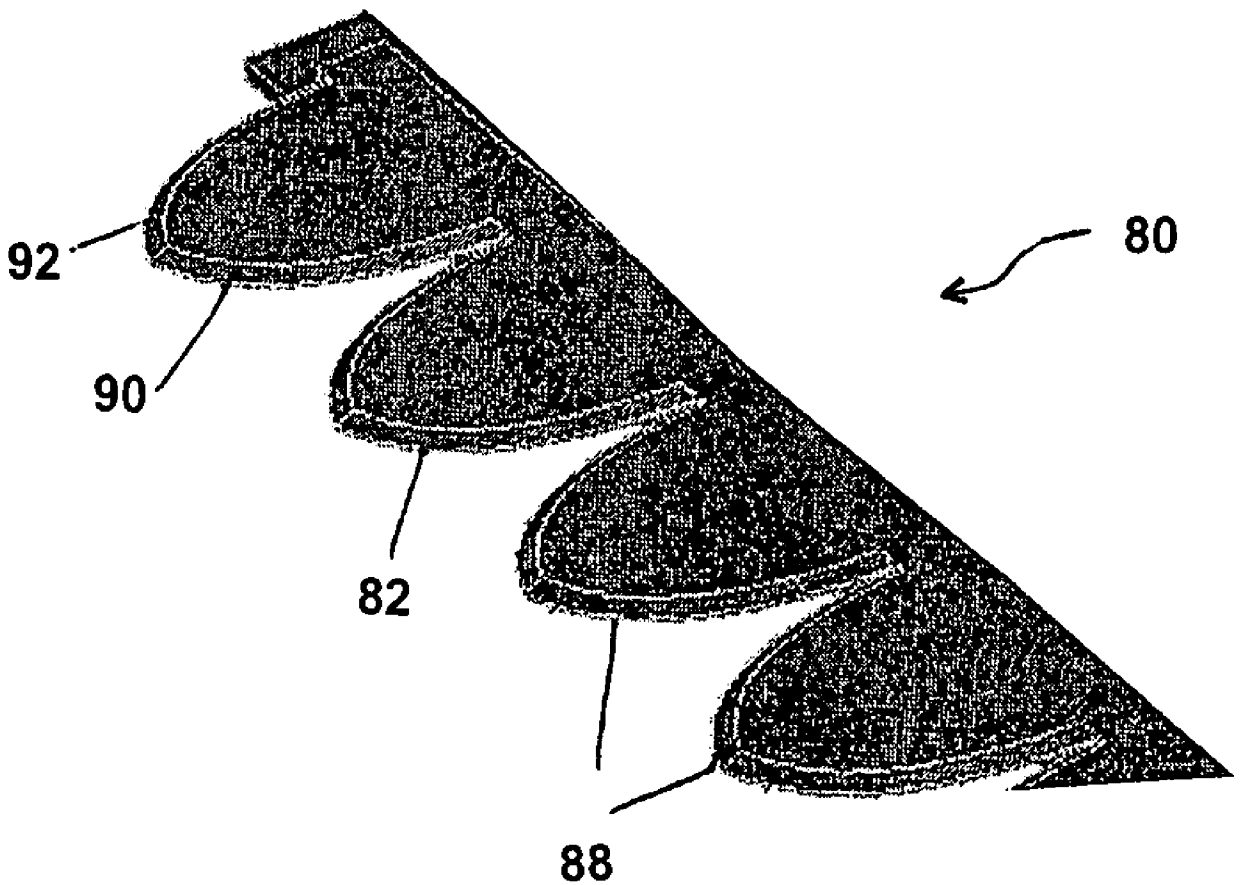
FIG. 1B is an enlarged, partial view of the blade shown in the embodiment of FIG. 1A.

A first cutting edge 82 of the blade 80 may include a plurality of serrations 88 as shown in FIGS. 1A and 1B. Preferably, each serration 88 includes an arch-shaped cutting edge 90, each edge 90 having a beveled portion 92 along the arch. Preferably, the first cutting edge 82 includes a plurality of discrete serration 88 where each serration forms its own cutting blade. In some embodiments, the blade 80 may include a second cutting edge. Alternative configurations for the first and second cutting edges are possible including a crenate-type, scalloped, waffle-like, v-shaped cutting edge, and the like as will be understood by one skilled in the art. In some embodiments, the first cutting edge or the second cutting edge may be a straight edge. Preferably, the cutting edges are formed from metal, such as stainless steel, however, any suitable material for forming a cutting edge may be used.

In some embodiments of the present invention, the slicing device 10 may include a single blade 80 that may be removably or non-removably mounted to the frame 14. Any of the configurations described above for the cutting edges may be used in a device having a single blade.

When the slicing device 10 includes a removable blade 80, the slicing device 10 may further include a slot 98 in the frame 14 for storage of the blade 80 when the device 10 is not in use and folded for storage in the second configuration 30. The blade 80 may also be stored in the slot 98 when the device 10 is in the first configuration 12. An exemplary slot 98 is shown in FIG. 3. Preferably, the slot 98 is formed in the bottom frame section 46 of the frame 14 so that the blade 80, when inserted into the slot 98 will extend beneath the second guiding plate 18 and protect the blade 80 to prevent unwanted slicing. The slot 98 may also be formed in the top frame section 44.

As described above, the slicing device 10 may further include an adjustment control member 22. The control member 22 may be used to adjust the vertical position of the first guiding plate 16 and the rotational position of a julienne blade 102 on a rotating cylinder 104 as shown in FIG. 3. The julienne blade 102 may include a plurality of upstanding cutting edges 103. The cylinder 104 may have a non-circular, generally outwardly spiraling exterior 105, as shown and described with reference to FIGS. 8A-F. Preferably, the adjustment control member 22 includes a shaft 58 that extends through the connecting members 50, 52. A retaining member 106 may be connected to a first end 107 of the shaft 58 and be sized to be partially inserted into an opening 108 in one of the connecting members 52 to position the shaft 58 in place for operation (described below).

A release member 110 having an adjusting knob 112 mounted thereto may be operably connected to the first end 107 of the shaft 58. A spring 111 may be placed between the retaining member 106 and the release member 110. A washer 115 may be placed between the retaining member 106 and the connecting member 52 and be sized and shaped to fit in a groove 117 in the connecting member 52. A second end 113 of the shaft 58 may extend through an opening 114 formed in the other connecting member 52, and the second end 113 of the shaft 58 may be operably connected to a locking member 116 having a spring 118. Additional arrangements for the adjusting control member 22 are possible for substantially vertical movement of the first guiding plate 16 and for rotational movement of the rotating cylinder 104, as will be understood by one skilled in the art. Alternatively, the adjustment control member 22 may be used for vertical movement or rotational movement alone when both features are not included in an embodiment or when additional adjusting control members are present.

As shown in FIGS. 1 and 3, the slicing device 10 may further include the stand 24 at a first end 120 of the frame 14. The stand 24 may be used to elevate the first end 120 with respect to a second end 122 of the frame 14 for enabling the user to slice food products with the guiding plates 16 and 18 at an angle relative to a preparation surface such as a counter (not shown). Preferably, the stand 24 operably connects to the top frame section 44 of the frame 14 and may be extended for elevation of the first end 120 of the frame 14 when the slicing device 10 is in the open configuration 12, as shown in FIG. 1A, and folded against the top frame section 44 for storage in the closed configuration 30 as shown in FIG. 4. The stand 24 may be made as a single, continuous, piece, or as a plurality of pieces as will be understood by one skilled in the art.

Figure 5:
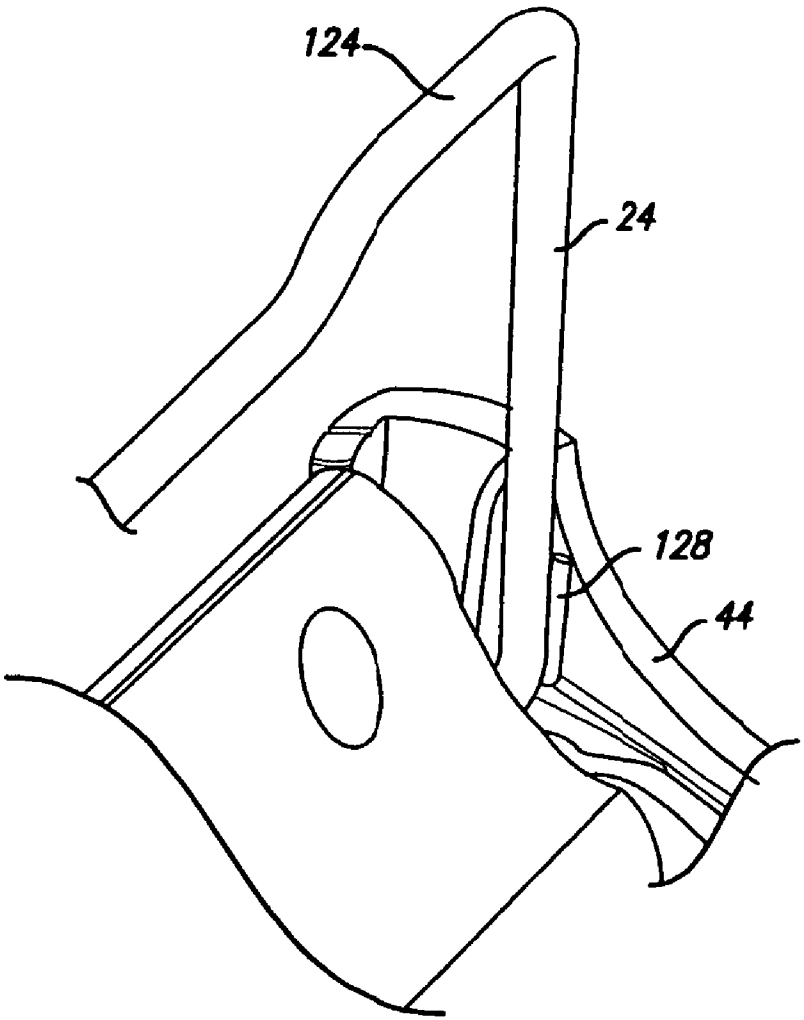
FIG. 5 is an enlarged, partial view of the stand shown in FIG. 4 in an extended position.

For example, as shown in FIGS. 1 and 4, the stand 24 may be formed from a single wire forming a substantially rectangular loop between side portions of the top frame section 44. The stand 24 shown in FIG. 1A includes a pair of contact regions 124 for contacting the work surface. A recessed region 126 may connect the two contact regions 124. As shown in FIG. 5, the stand 24 may be releasably secured in the extended position by a pair of detents 128 formed in the top frame section 44. The detents 128 may be adapted to hold the stand 24 in the extended position for operation and to allow release of the stand 24 for storage when the user presses on the stand 24 to fold the stand 24 inwardly toward the top frame section 44. As shown in FIG. 4, the top frame section 44 may include recessed channels 130 in the serrated edge portion 26 for receiving a portion of the stand 24 and releasably securing the stand 24 for storage. The contact regions 124 may abut a longitudinal cross member 132 of the top frame section 44 and the recessed region may abut a protrusion 134 extending from the cross member 132 to help to releasably secure the stand for storage. Additional configurations for releasably securing the stand 24 in the extended and storage positions are possible including but not limited to latches and the like. The slicing device 10 may further include or alternatively include a second stand operably connected to the bottom frame section 46 (not shown). One of skill in the art will understand that the second stand may be configured similarly to the stand 24 and have a different height relative to the stand 24 operably connected to the top frame section 44 to provide an angular orientation for the guiding plates 16, 18.

Figure 6:
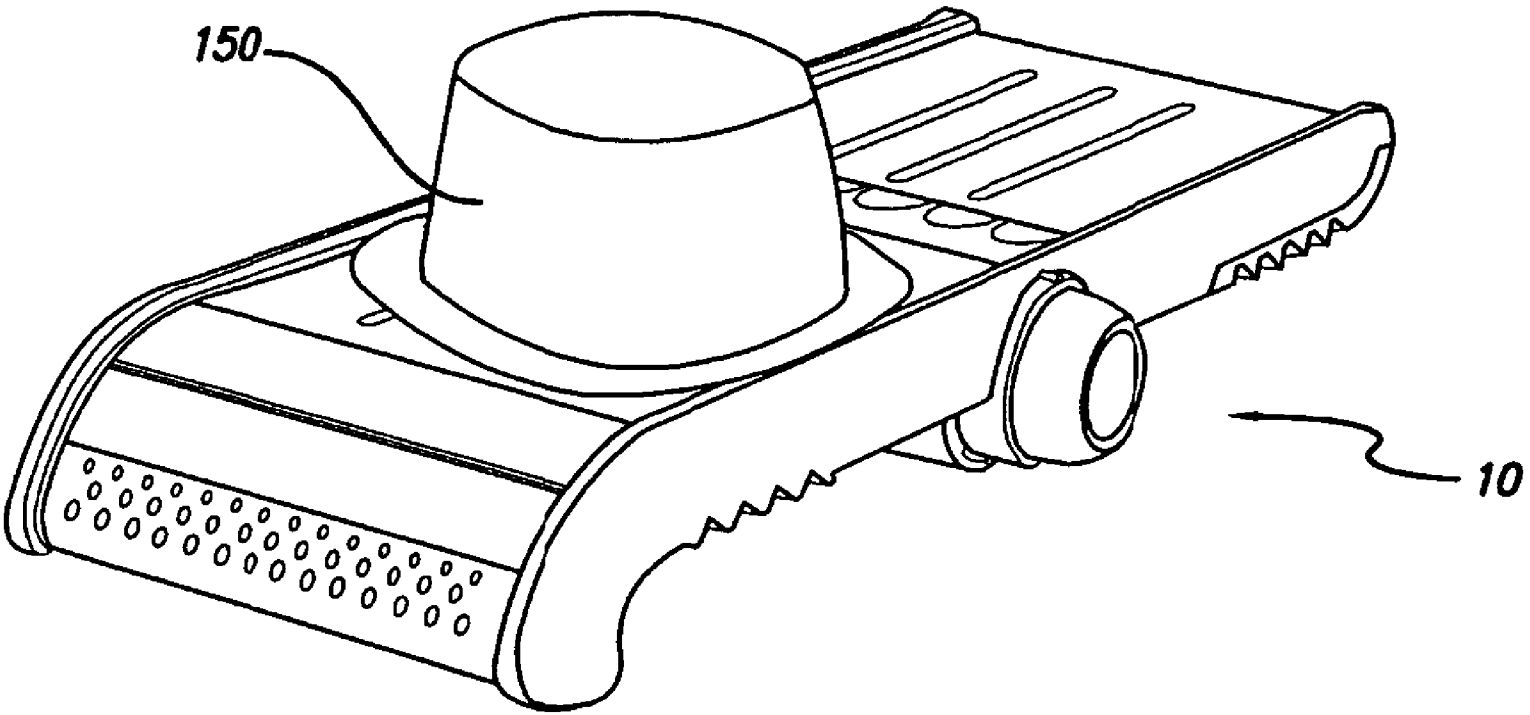
FIG. 6 is a perspective view of an embodiment of the slicing device having a holder.
Figure 7:
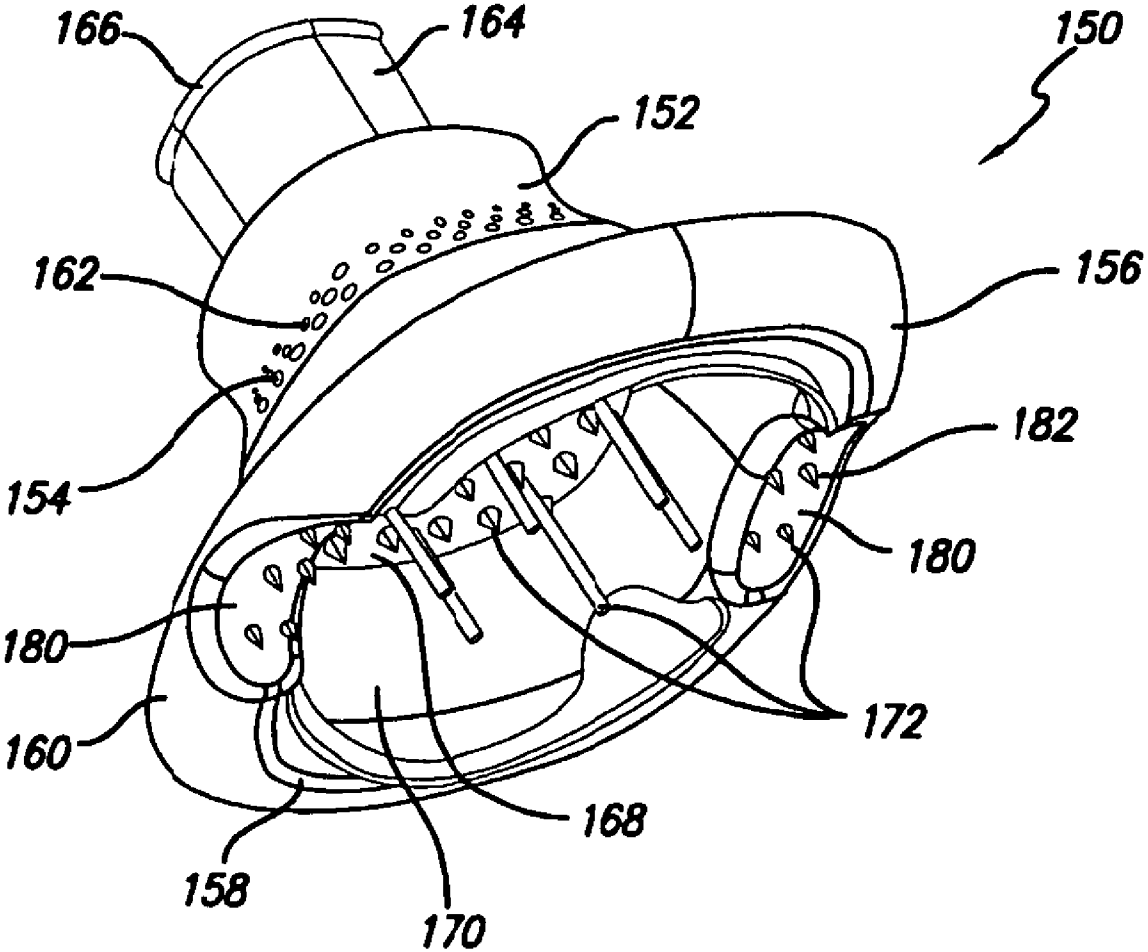
FIG. 7 is a perspective view of a holder that may be used with the slicing device of the present invention.
Figure 8:
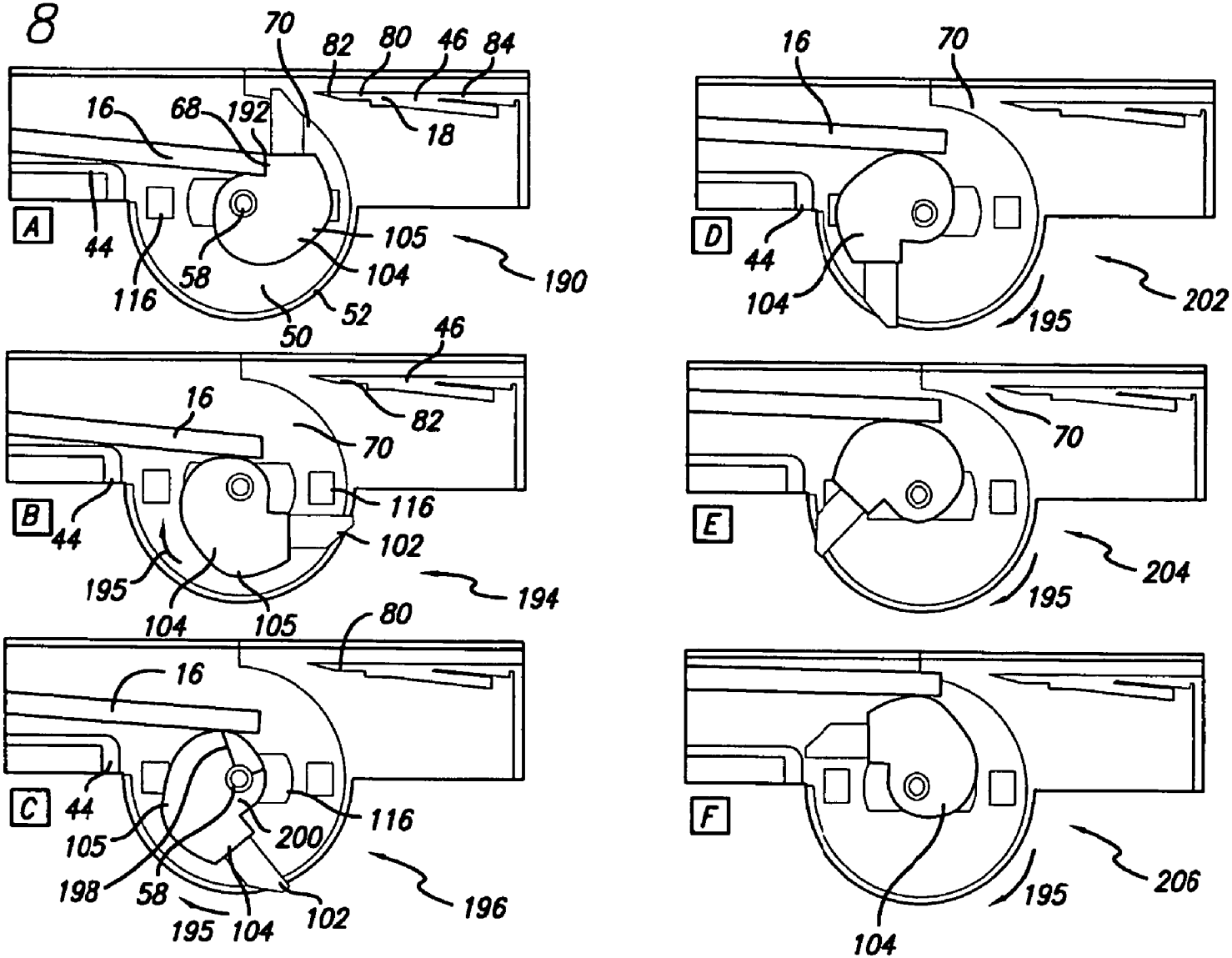
FIGS. 8A-F are cross-sectional side views of the embodiment shown in FIG. 1A wherein the adjustment control member is shown in a plurality of positions.

In some embodiments of the present invention, a holder 150 may be provided for holding the food products during slicing operation as shown in FIGS. 6 and 7. The holder 150, as shown in FIG. 7 may include a body 152 having a gripping region 154 and a rim 156 at a base portion 158 of the holder body 152. The rim 156 may extend radially outwardly from the base 152 and may curve upwardly at an edge 160. The rim 156 may extend outwardly to protect the user's fingers during operation of the slicing device 10. The gripping region 154 may include protrusions 162 or ribs to facilitate gripping of the holder 150. A plunger 164 may extend upward from the holder body 152. The plunger may be advanced by the user pressing down on a proximal end 166 of the plunger 164. The plunger 164 may be connected to a plate 168 within a recessed cavity 170 formed in the body 152 for receiving the food product. A plurality of pins 172 may extend through the plate 168 adapted for inserting into and holding the food product during slicing with the device 10. Optionally, a portion of the pins 172 may extend from the plate 168. As shown in FIG. 7, the pins 172 may have a variety of widths, lengths and shapes, including straight and pyramid-shaped. The lengths may also vary. For example, the embodiment shown in FIG. 7 includes longer straight pins 172 with shorter, pyramid-shaped pins 172. Additional shapes, lengths and widths may be used as well as additional patterns of alternating pins. Alternatively, a uniform pattern of pins 172 may be used. The plunger may be adapted for advancing the plate 168 downward toward the sliding device 10 as the food product is repetitively passed across the blade 80 and the food product becomes smaller. The pins 172 may remain stationary within the body 152 so that the food product is pushed along the pins 172 as the plate 168 advances, eventually pushing the food product off the pins 172 when the food product has been essentially completely sliced.

In some embodiments, the holder 150 may include recesses 180 in a portion of the rim 156. The recesses 180 may include pins 182 similar to the pins 172 described above. The recesses 180 and pins 182 may serve to additionally secure the food product to the holder 150 for slicing with the device 10. As shown in FIG. 7, the holder 150 may have a generally square-shaped body 152 and rim 156, although any overall shape may be used for the holder 150, including circular, oval, rectangular, triangular and the like. Any suitable food holding device know in the art may also be used with the slicing device of the present invention.

In operation, the slicing device 10 is used in the open configuration 12 as shown in FIG. 1A. The frame 14 may be locked in the open configuration 12 during operation (described below). The stand 24 may be extended outwardly from the top frame section 44 if the device 10 is to be used with the guiding plates 16, 18 at an angle with respect to the work surface. Alternatively, the stand 24 may be folded inwardly for storage where the stand 24 is secured in the channel 130 and against the cross member 132 of the top frame section 44. With the stand 24 in the storage position, the serrated edge portions 26 and 28 may be placed on the edge of a container for receiving the sliced food product.

In some embodiments of the present invention, where the blade 80 is removable, the blade 80 may be inserted into a slot in the frame 14 using a handle to safely insert the blade 80 so that the desired cutting edge is exposed for slicing in the opening 70. The cutting edge may be exchanged for an alternate cutting edge while the device is in the open configuration 12.

The adjustment control member 22 may be operated to control the vertical height of the first guiding plate 16 with respect to the second guiding plate 18 and to expose the julienne blade 102. Exemplary operation of the adjustment control member is described with respect to six possible positions for the cylinder 104, but one of skill in the art will understand that a plurality of positions and operations are possible for the adjustment control member and operation is not limited to the example herein.

FIGS. 8A-F illustrate the rotation of the cylinder 104 to adjust the guiding plate 16 for changing the thickness of slices and to expose the julienne blades 102. Each of the FIGS. 8A-F is oriented with the first guiding plate 16 adjustably mounted on the top frame section 44 and the blade 80 mounted to the bottom frame section 46 with the cutting edge 82 extended into the opening 70 and the cutting edge 84 stored. The cylinder 104 is shown operably connected to the shaft 58 and the locking member 116. The locking member 116 is engaged with the connecting member 52 of the bottom frame section 46 which is engaged with and overlapping the connecting member 50 of the top frame section 44 to secure the device 10 in the open configuration 12.

In operation, the food product is passed across the first guiding plate 16 and across the opening 70 to the cutting edge 80, from left to right as shown in the cutting direction 17. Slices of the food product pass through the opening 70 of the device 10 into a container or onto a work surface. The remaining food product may be repeatedly passed across the device 10 until all of the food product has been sliced.

FIG. 8A shows the cylinder 104 in a first position 190 wherein the julienne blades 102 are upstanding from the cylinder 104 and exposed in the opening 70 for julienning the food product as the food product is passed across the julienne blades 102 and toward the cutting edge 82. In the first drum position 190, the first guiding plate 16 abuts the top frame section 44 and the end 68 of the first guiding plate sits in a notch 192 of the cylinder 104. When the first guiding plate 16 abuts the top frame section 44 in the position 190, the opening 70 is maximally open between the first guiding plate 16 and the second guiding plate 18 for making the thickest slices. In some embodiments, the julienne blades 102 may be rotated out of the first position 190 when the user rotates and presses on the adjusting knob 112 to release the julienne blades 102 (see FIG. 12). In some embodiments, the julienne blades 102 may be rotated out of the first position when the user presses and rotates the control member 322 (described below and shown in FIG. 13).

FIG. 8B shows the cylinder 104 in a second position 194 wherein the julienne blades 102 are rotated in a clockwise direction 195 about 90° from the upstanding first position 190 position shown in FIG. 8A and away from the opening 70. The first guiding plate 16 abuts the top frame section 44 and the opening 70 is maximally open as described above.

FIG. 8C shows the cylinder 104 in a third position 196 where the cylinder 104 is further rotated in the clockwise direction 195 from the position shown in FIG. 8B. As shown, a second distance 198 extending from the shaft 58 to the exterior 105 of the cylinder 104 is greater than a first distance 200 extending from the shaft 58 to the exterior 105 of the cylinder 104. The differences between the distances 198 and 200 illustrate the outward spiral of the exterior 105. The increasing outward spiral exterior 105 provides for a decrease in the opening 70 between the first guiding plate 16 and the second guiding plate 18 as the cylinder 104 is rotated in the clockwise direction 195. As shown in FIG. 8C, the first guiding plate 16 is lifted away from the top frame section 44 by the cylinder 104.

FIGS. 8D and 8E illustrate the cylinder 104 in a fourth position 202, and a fifth position 204, respectively, where the cylinder 104 is rotated in a clockwise direction 195 from the position 196 shown in FIG. 8C. With the further rotation of the cylinder 104 in the clockwise direction 195, the opening 70 further narrows to provide for thinner slices.

FIG. 8F illustrates the cylinder 104 rotated to a sixth position 206 in the clockwise direction 195. In the sixth position 206, the julienne blade 102 is stored between the first guiding plate 16 and the top frame section 44 to prevent accidental injury to the user. In addition, the first guiding plate 16 is substantially parallel to the second guiding plate 18.

In some embodiments of the present invention, the frame 14 of the slicing device 10 may be folded to the second configuration 30 when the cylinder 104 is rotated to the sixth position 206. Folding of the device 10 may be prevented when the cylinder 104 is in a position other than the sixth position 206. As described below, the slicing device 10 may be released from the first configuration 12 by pressing the release member 110, 310 to allow folding to the second configuration 30.

Figure 9:
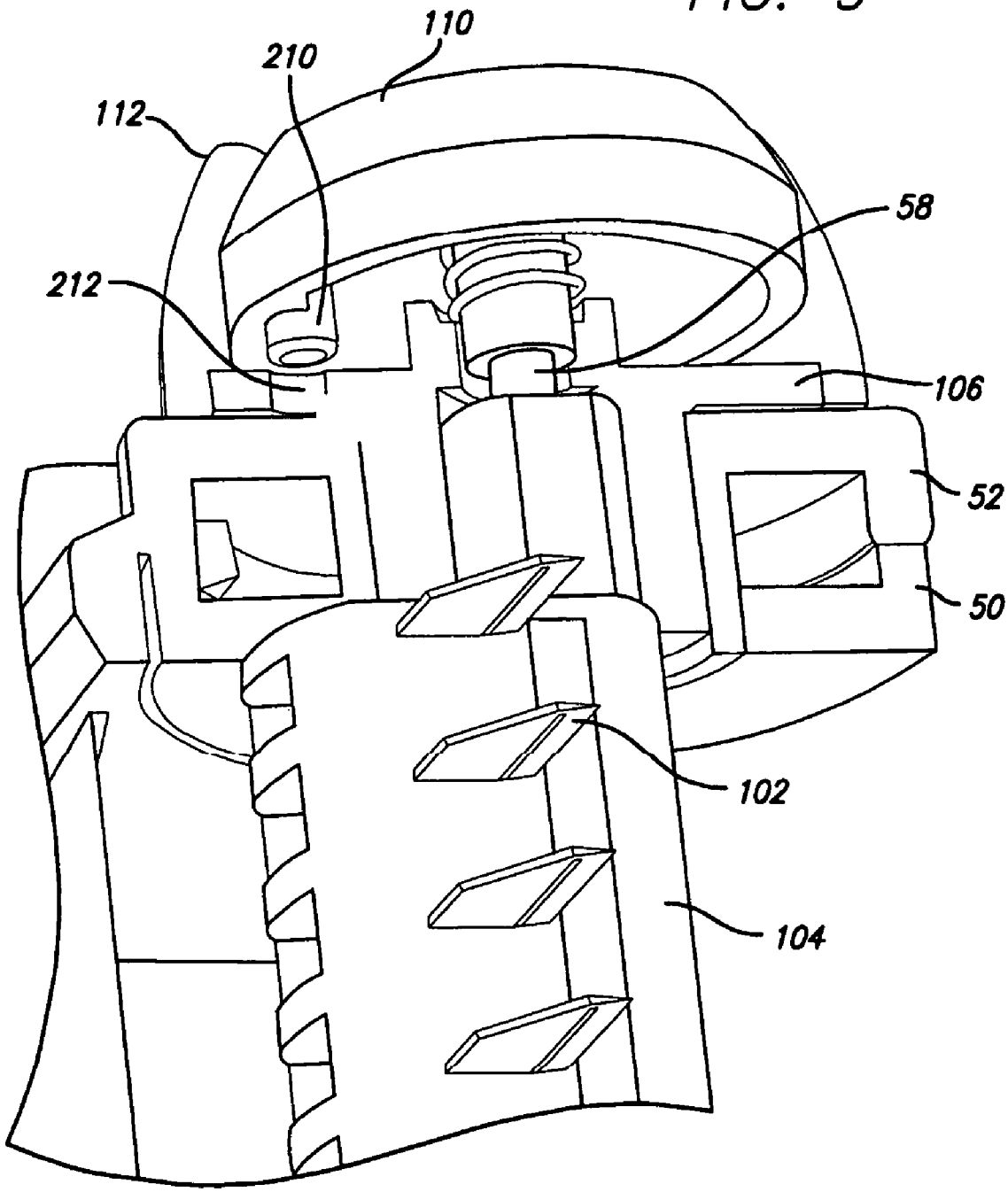
FIG. 9 is an enlarged partial view of the adjustment control member of the present invention.
Figure 11:
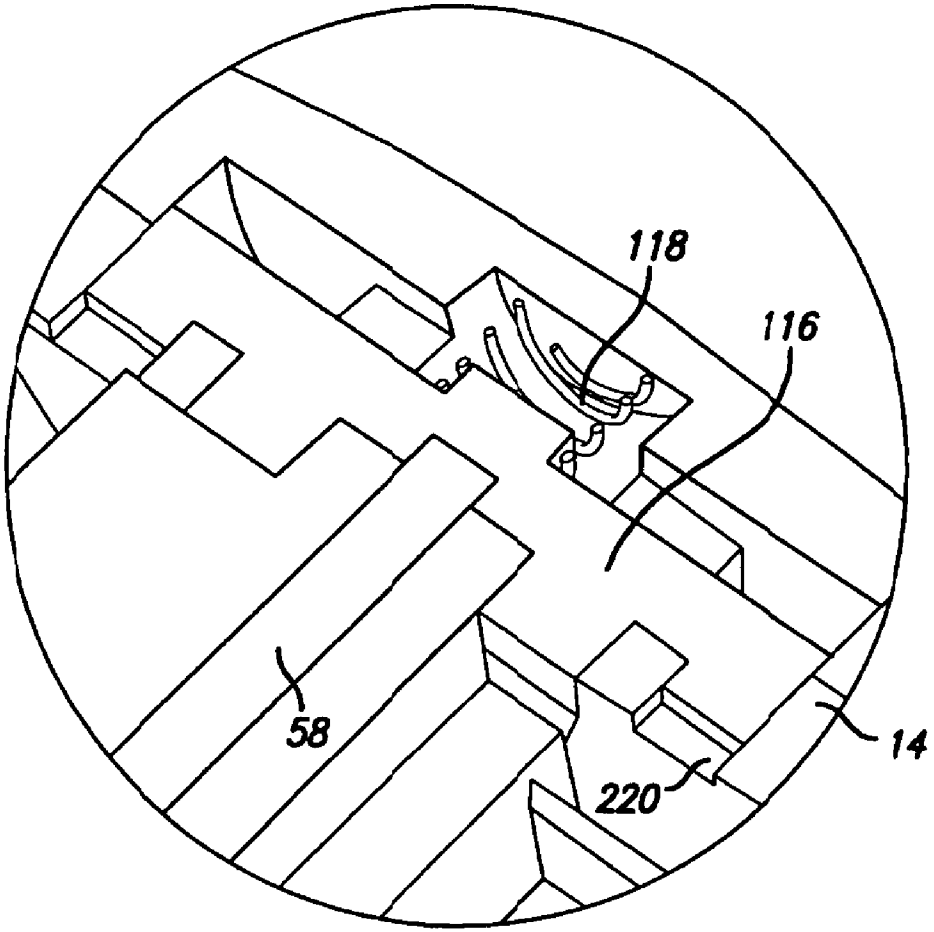
FIG. 11 is an sectional view of the adjustment control member shown in FIG. 10 taken along line A.
Figure 10:
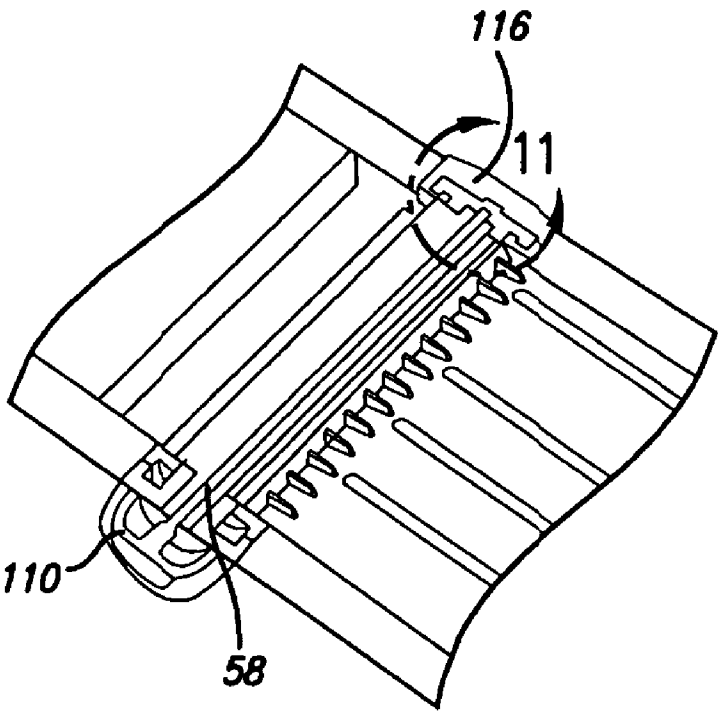
FIG. 10 is a perspective view of the adjustment control member shown in FIG. 9.

The adjustment control member 22 operates to move the cylinder 104 to the positions described above and to lock and unlock the device 10. Operation of one embodiment of the locking feature and adjustment of the control member 22 of the device 10 is illustrated. in FIGS. 9-12. FIG. 9 shows the cylinder 104 in the sixth position 206 described above. When the cylinder 104 is in the sixth position 206, an actuator button 210 connected to the release member 110 may be aligned with a recess 212 in the retaining member 106. When the actuator button 210 is aligned with the recess 212, the release member 110 may be depressed to activate the shaft 58. As shown in FIGS. 10 and 11, the shaft 58 presses on the locking member 116, which is biased against the frame 14 in the locked position by the spring 118, and compresses the spring 118 to allow the locking member 116 to move out of slots 220 in the frame 14. Once the locking member 116 is removed from the slots 220, the frame 14 may be folded into the closed configuration 30 for safety and storage.

In some embodiments of the present invention, the blade 80 may be removed from a slot in the frame where the cutting edge of the blade is exposed and stored in the slot 98 of the bottom frame section 46, preferably prior to folding the frame 14 into the second configuration 30.

Figure 12:
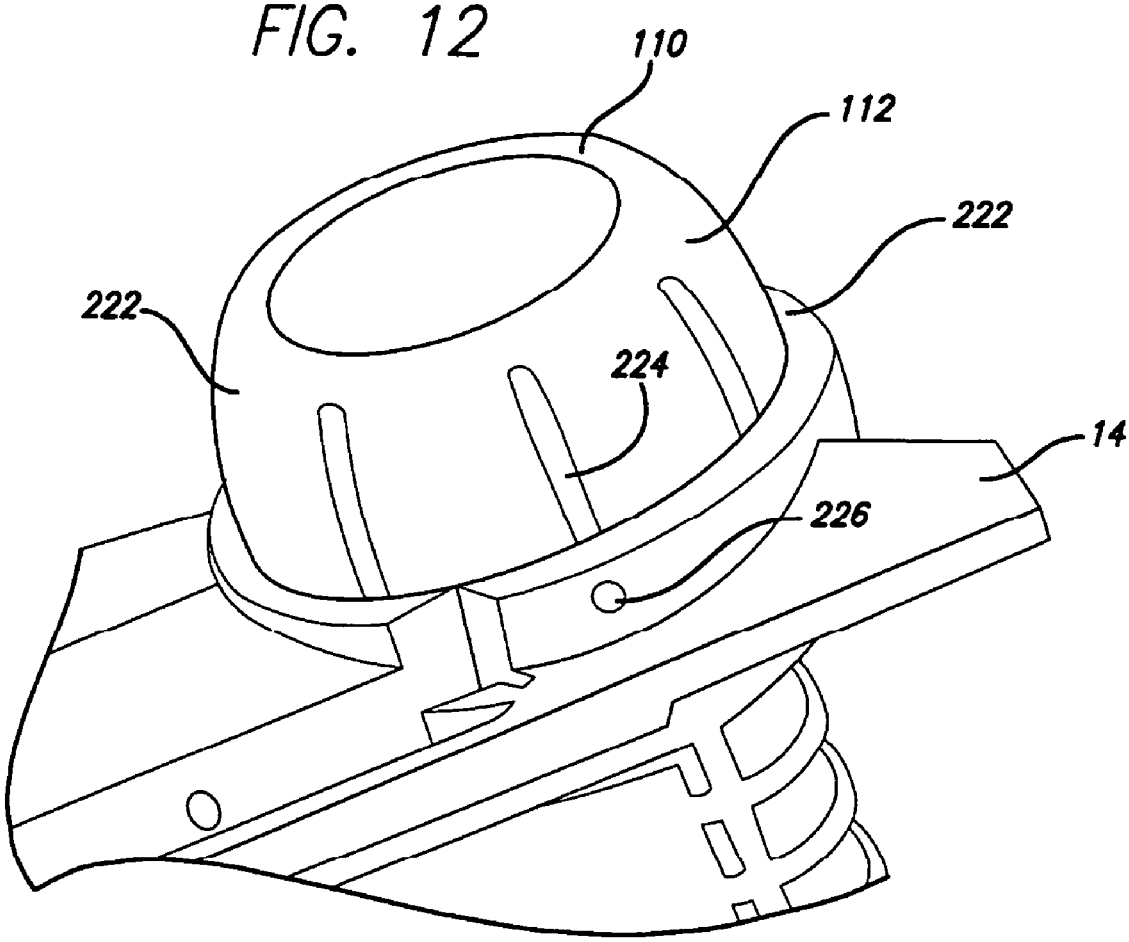
FIG. 12 is a partial view of the adjustment control member.

As shown in FIG. 12, rotation of the cylinder 104 may be controlled by the adjusting knob 112 connected to the release member 110. The adjusting knob 112 may include a plurality of grooves 222 relating to the cylinder 104 positions described above. As shown in FIG. 12, the sixth position 206 may be indicated by markers 224 and 226 on the adjusting knob 112 and the frame 14 respectively. The cylinder 104 may be rotated to each of the six positions described above using the adjusting knob 112 and aligning each of the grooves 222 with the marker 226 on the frame 14 to indicate when the cylinder is in a specified position. Alternative mechanisms may be used to control the rotation of the cylinder 104.

Figure 13:
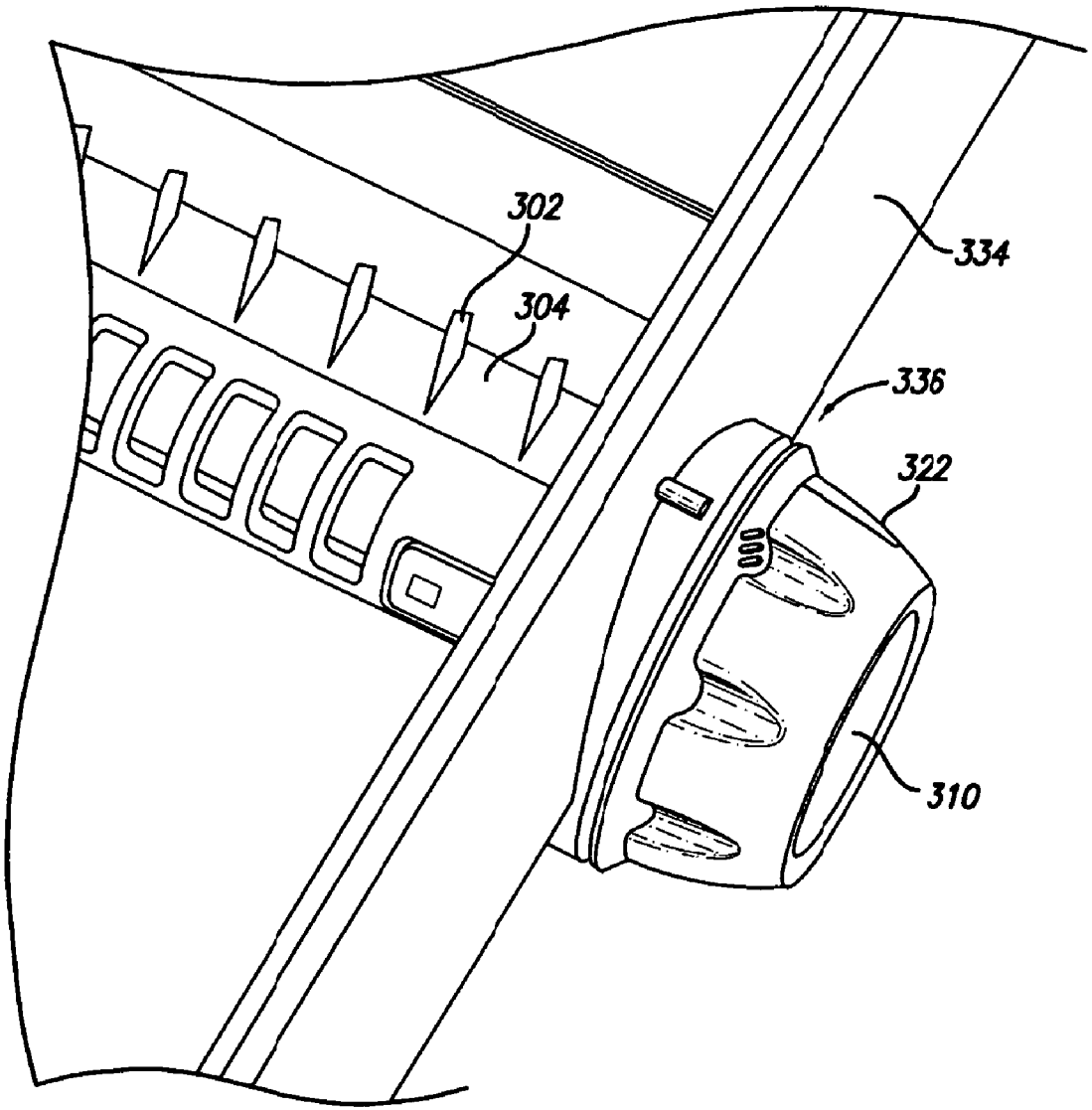
FIG. 13 is a partial view of an alternative embodiment of the adjustment control member.
Figure 14:
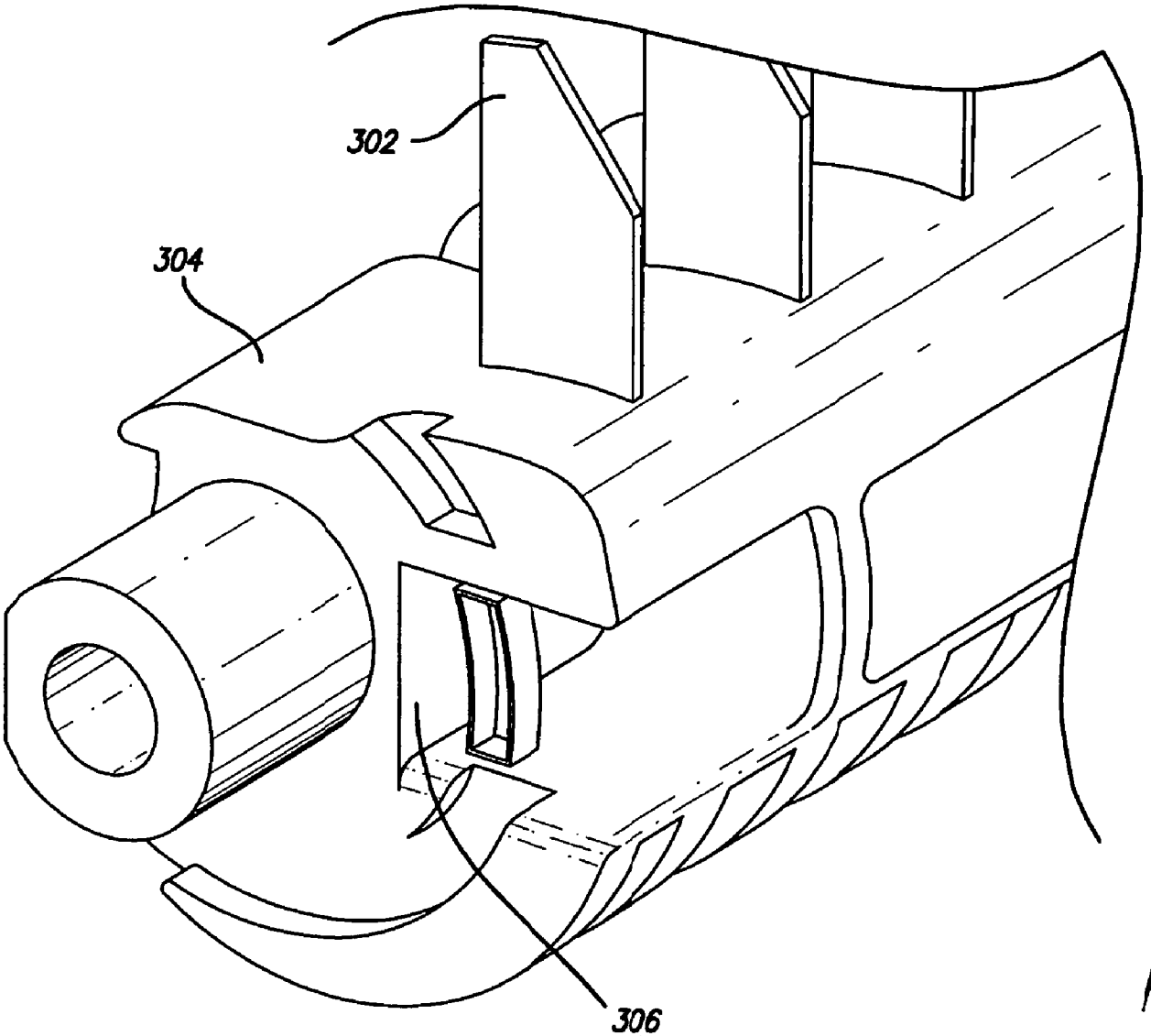
FIG. 14 is a partial view of the cylinder shown in FIG. 13.

Another embodiment of the locking feature of the device 10 is illustrated in FIGS. 13 and 14. FIG. 13 illustrates a cylinder 304 in the sixth position 206 (described above) with a julienne blade 302 exposed for cutting. When the julienne blade 302 is in the exposed position for cutting, the cylinder 304 is locked in position by a protrusion on the frame (not shown) that engages a recess 306 in the cylinder 304. The recess 304 can be seen in FIG. 14. As shown in FIG. 13, when the cylinder 304 is in position and locked with the julienne blade 302 exposed for cutting, a control member 322 is spaced apart from the frame 334 to form a gap 336. A release member 310 is depressed to release the cylinder 304 from the locked position. When the release member 310 is depressed, the gap 336 between the control member 322 and the frame 334 disappears and the control member is rotated to the next position. For rotation to the other positions shown in FIG. 8, the control member 322 is spaced apart from the frame 334 having the gap 336 therebetween with the control member 322 rotatable without pressing the release member 310.

While preferred embodiments of the invention have been described, it should be understood that the invention is not so limited and modifications may be made without departing from the invention. The scope of the invention is defined by the appended claims, and all devices that come within the meaning of the claims, either literally or by equivalence, are intended to be embraced therein.

The invention claimed is:

1. An adjustable slicing device comprising:

a foldable frame;

an opening formed in said frame having a cutting edge of a blade extending at least partially across said opening;

a guiding member adjustably mounted in said frame, said guiding member having an edge portion adjacent said opening; and an adjustment control member mounted to said frame; said adjustment control member being operable to releasably lock said frame in an open configuration and being operable to change a substantially vertical orientation of said edge portion, wherein when said frame is locked in said open configuration said frame is prevented from leaving said open configuration.

2. The adjustable slicing device of claim 1, wherein said adjustment control member further comprises a second blade.

3. The adjustable slicing device of claim 1, wherein said adjustment control member comprises a rotatable cylinder rotatable to a plurality of positions.

4. The adjustable slicing device of claim 3 wherein said adjustment control member includes a position wherein additional blades are extended into said opening.

5. The adjustable slicing device of claim 1, wherein the cutting edge comprises a plurality of serrations.

6. The adjustable slicing device of claim 5, wherein each of the plurality of serrations is arch-shaped.

7. An adjustable slicing device comprising:

a frame having a first portion supporting a first guide plate and a second portion supporting a second guide plate, said first and second portion being pivotally connected to allow said frame to be movable between an open configuration and a folded configuration;

in said open configuration, said first and second guide plates substantially align to provide a food guide surface across said first and second guide plates and in said folded configuration, said first and second guide plates are positioned in a generally overlying configuration;

a first blade mounted to at least one of said first and second guide plates and said frame; and an adjustment control member for adjusting a height of at least one of said first and second guide plates, the adjustment control member including a rotary locking member, the locking member being adapted to releasably lock said frame into said open configuration, wherein when said frame is locked in said open configuration said frame is prevented from leaving said open configuration.

8. The adjustable slicing device of claim 7, wherein said adjustment control member comprises a second position for adjusting a substantially vertical orientation of said first guiding plate.

9. The adjustable slicing device of claim 7, wherein said adjustment control member comprises a rotatable cylinder rotatable to a plurality of positions.

10. The adjustable slicing device of claim 9, wherein said rotatable cylinder further comprises a second blade mounted to said cylinder.

11. The adjustable slicing device of claim 10, wherein said second blade comprises a plurality of upstanding cutting edges adapted for cutting a food product into strips.

12. The adjustable slicing device of claim 7, wherein in said first blade is removably mounted in said frame.

13. The adjustable slicing device of claim 7, further comprising a stand operably connected to a first end of said frame, said stand being adapted for movement to a storage position.

14. The adjustable slicing device of claim 7, further comprising serrated edge portions on said frame.

15. The adjustable slicing device of claim 7, further comprising a holder adapted for holding a food product for movement of said food product across said first blade.

16. The adjustable slicing device of claim 7, wherein said folded configuration is a storage configuration.

17. The adjustable slicing device of claim 7, wherein said frame further comprises a slot formed in said frame for storing said blade.

18. The adjustable slicing device of claim 7, wherein said first blade comprises:

an elongate body extendable across a portion of said opening in said adjustable slicing device; and said cutting edge comprises a first edge on said body, said first edge comprising a plurality of cutting edges extending outwardly from said body into said opening.

19. The blade of claim 18, wherein each of said plurality of cutting edges comprises an arch-shaped cutting edge.

20. The blade of claim 19, wherein each of said cutting edges comprises a bevel.

21. The adjustable slicing device of claim 7, further comprising an adjustment control member, said member configured to selectively release said frame from said open configuration.

* * * * *